US005640788A

United States Patent [19]

Thange

[11] Patent Number: 5,640,788

[45] Date of Patent: Jun. 24, 1997

[54] NOISE-MAKING SOLE FOR FOOTWEAR

[76] Inventor: Maqsood Thange, 1005 Sheryl Dr., Islin, N.J. 08830

[21] Appl. No.: 598,653

[22] Filed: Mar. 8, 1996

[51] Int. Cl.[6] ..... A43B 3/30

[52] U.S. Cl. ..... 36/139; 36/112

[58] Field of Search ..... 36/112, 139, 1, 36/3 B, 28

[56] References Cited

U.S. PATENT DOCUMENTS

| | | | |
|---|---|---|---|
| 4,253,254 | 3/1981 | Giu | 36/139 |
| 4,787,100 | 11/1988 | Jonas | 36/139 X |
| 5,421,107 | 6/1995 | Bryan | 36/112 X |

FOREIGN PATENT DOCUMENTS

| | | | |
|---|---|---|---|
| 2191383 | 12/1987 | United Kingdom | 36/139 |

*Primary Examiner*—B. Dayoan
*Attorney, Agent, or Firm*—Alfred C. Hill

[57] ABSTRACT

A sole for the footwear has an inner surface and an outer surface including a heel. A spongy material is disposed adjacent the inner surface over a majority of the sole remote from the heel and a sheet of material covers the inner surface and the spongy material. A cylindrical passageway is disposed in the sole in communication with the spongy material and an exterior of the heel adjacent a back of the footwear. A one-way air noise-maker is disposed in the passageway adjacent the exterior of the heel, the noise-maker enabling the spongy material to draw air therethrough after a step is taken and the spongy material is deflated to inflate the spongy material without emitting noise and to make noise by air passing therethrough when a step is taken and the spongy material is deflated thereby providing only a single noise per step of a person wearing the footwear.

20 Claims, 2 Drawing Sheets

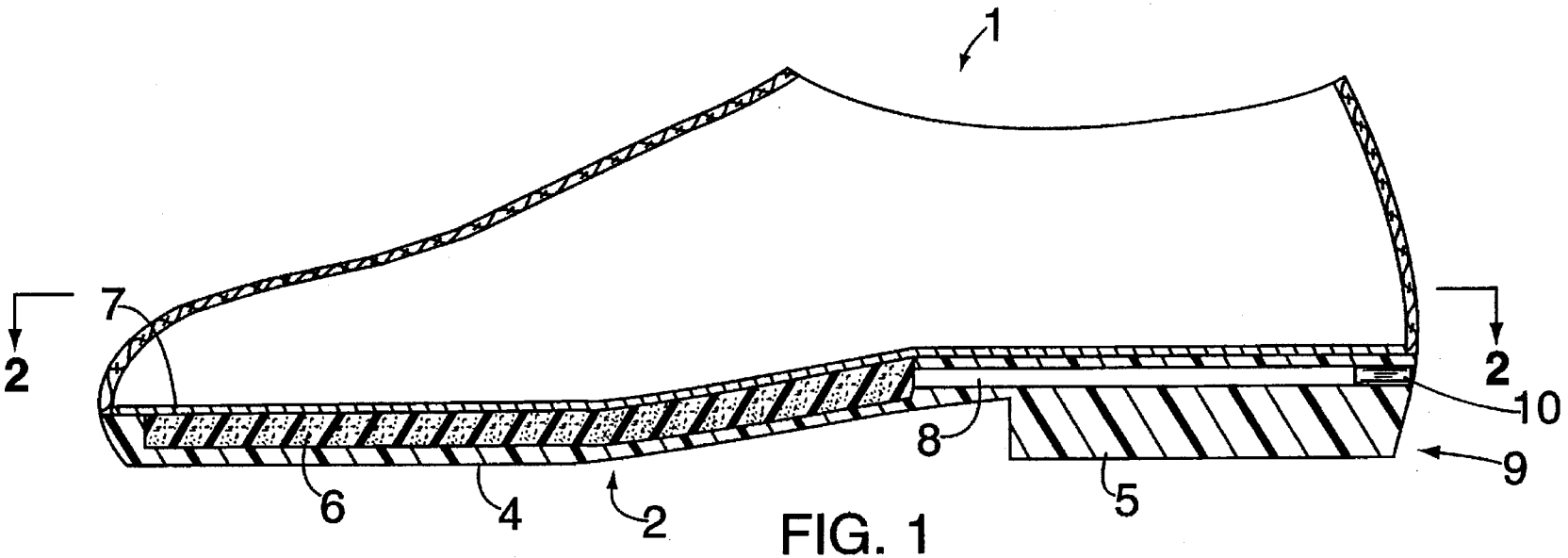
FIG. 1
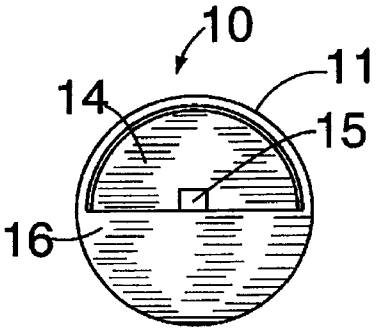
FIG. 4
FIG. 5
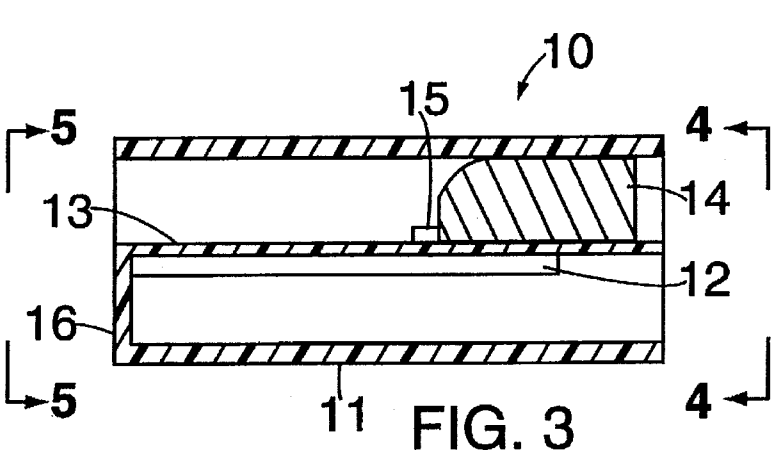
FIG. 3

NOISE-MAKING SOLE FOR FOOTWEAR

BACKGROUND OF THE INVENTION

The present invention relates to the field of children and adult shoes and more particularly to such shoes having disposed therein an arrangement to operate a noise-making device.

Shoes of elastomer and fabric constructions, originally intended for jogging, baseball and other sports activities, have become the footwear of choice for adults and the youth of the day. Needless to say, the youngest are no exception and frequently it has been found that three years old are shod, "just like big brother and sister".

Footwear outfitted with noise-making devices have been disclosed in prior U.S. Patents to Gill, U.S. Pat. No. 4,253,254 and Jonat, U.S. Pat. No. 4,787,100; and a U.K. Patent to Griffiths, U.S. Pat. No. 2,191,383. The disclosures in these patents as well as in U.S. Pat. No. 5,421,107 are novelty items for amusing a child, with practical benefits for encouraging toddlers to walk and to keep contact with small children while walking about or shopping. While the concept of these patents have merit in each of these areas, adults do not have a desire or, or even tolerance, for continuous noise. Moreover, a deformable cavity at either the toe portion of the sole taught by Jonat, or at the heel portion taught by Gill and Griffiths and the bulge in the sole of the Bryan patent will tend to impair support and comfort. Since presence of the noise-maker in the toe and heel as well as the arch area of the sole of the prior art tend to make the shoes uncomfortable for the wearer, such noise-makers have not become commercially viable products.

SUMMARY OF THE INVENTION

An object of the present invention is to provide a noise-making sole for footwear which will overcome the above-mentioned disadvantages of the prior art.

Another object of the present invention is to provide a noise-making sole wherein the noise-making device adds additional cushion to the footwear.

Still another object of the present invention is to provide a noise-making sole which does not hinder the walking gait of the wearer of the footwear.

A feature of the present invention is the provision of a noise-making sole for footwear comprising a sole for the footwear having an inner surface and an outer surface including a heel; a spongy material disposed adjacent the inner surface over a majority of the sole remote from the heel; a sheet of material covering the inner surface and the spongy material; a passageway disposed in the sole in communication with the spongy material and an exterior of the heel adjacent a back of the footwear; and a one-way air noise-maker disposed in the passageway adjacent the exterior of the heel, the noise-maker enabling the spongy material to draw air therethrough after a step is taken and the spongy material is deflated to inflate the spongy material without emitting noise and to make noise by air passing therethrough when a step is taken and the spongy material is deflated thereby providing only a single noise per step of a person wearing the footwear.

BRIEF DESCRIPTION OF THE DRAWING

Above-mentioned and other features and objects of the present invention will become more apparent by reference to the following description taken in conjunction with the accompanying drawing, in which:

FIG. 1 is a cross-sectional view of footwear incorporating the noise-making sole in accordance with the principles of the present invention;

FIG. 3 is a cross-sectional view along line 3—3 of FIG. 4 illustrating an embodiment of the beeper in accordance with the principles of the present invention;

FIG. 4 is an end view of FIG. 3 taken along line 4—4 of FIG. 3; and

FIG. 5 is an end view taken along line 5—5 of FIG. 3.

DESCRIPTION OF THE PREFERRED EMBODIMENT

Figure 2:
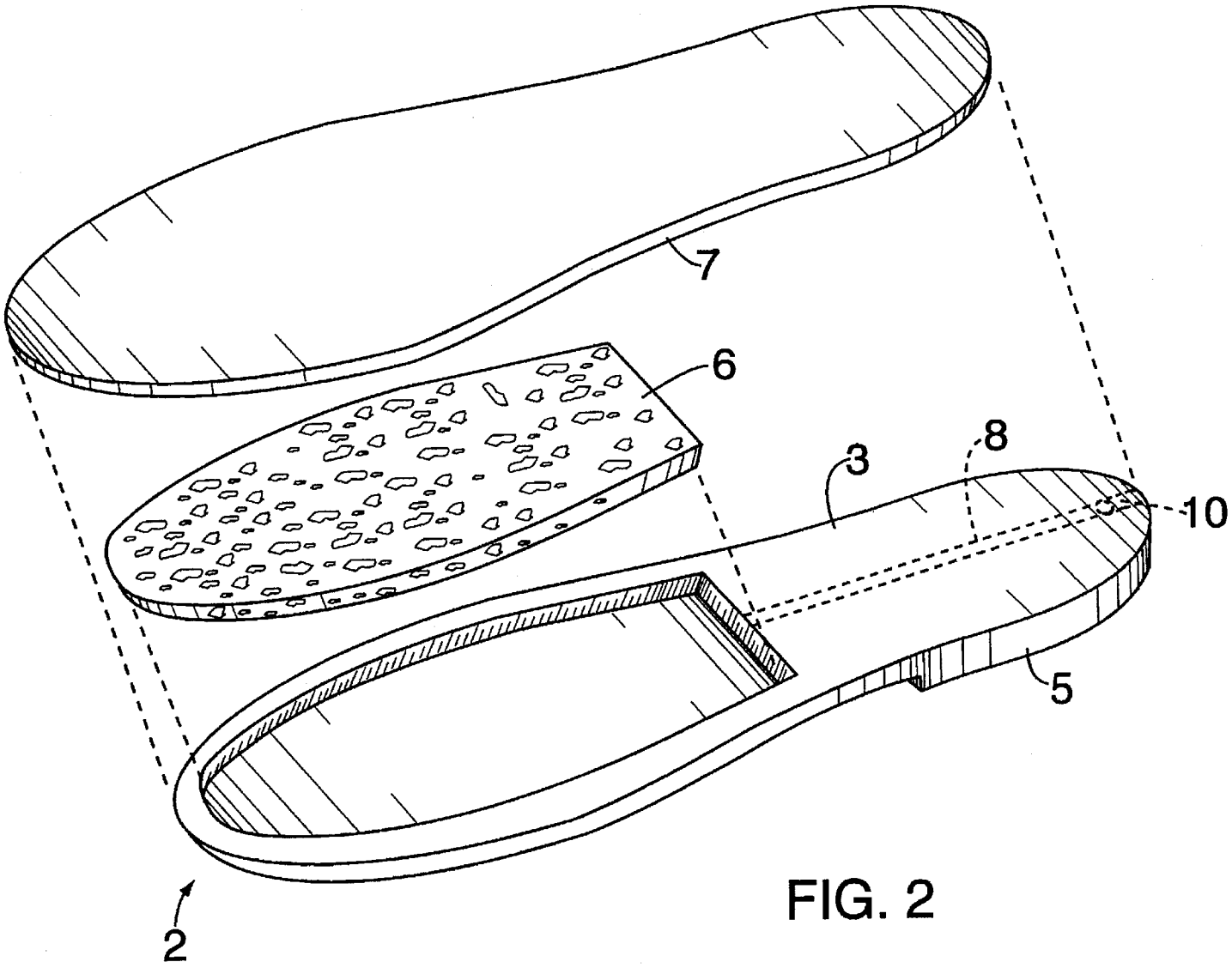
FIG. 2 is an exploded view of the noise-making sole in accordance with the principles of the present invention.

Referring to FIGS. 1 and 2, there is illustrated therein footwear 1 having a sole 2 including an inner surface 3 and an outer surface 4 including a heel 5. A sponge-like or spongy material 6 is disposed adjacent the inner surface 3 over a majority of the sole 2 remote from the heel 5. A sheet of material 7 covers the inner surface 3 and the material 6.

A cylindrical passageway 8 is disposed in the sole 2 in communication with the material 6 and an exterior of the heel 5 adjacent the back 9 of the footwear 1.

A one-way air noise-maker 10 is disposed in the passageway 8 adjacent the exterior of the heel 5, the noise-maker 10 enabling the material 6 to draw air therethrough after a step is taken and the material 6 is deflated to inflate the material 6 without emitting noise and to make noise by air passing therethrough when a step is taken and the material 6 is deflated thereby providing only a single noise per step of a person wearing the footwear 1.

The material 6 can be a sponge, spongy plastic, spongy cellulose, spongy rubber or the like. The sheet of material 7 can be a plastic sheet, a fiber sheet, a cardboard sheet or the like. The footwear 1 can be made of a fabric, cloth, plastic, rubber, leather or similar materials. Footwear 1 can be adult type footwear for either males or females and for baby shoes or childrens' shoes.

The noise-making sole 2 can be used by adults to keep track of their children in crowded areas, or in the home, and can also be employed by older children and adults as a novelty item. To disable the noise, the noise-maker 10 can be removed from passageway 8 by simply pulling the noise-maker out after disengaging the adhesive holding the noise-maker 10 in place in passageway 8.

Referring to FIGS. 3–5, the noise-maker 10 is illustrated as being a one-way air beeper which gives off a single beep for each step of the person wearing the footwear. This is in contrast to the prior art arrangements wherein the noise-makers in footwear give off two beeps, or noise, for each step.

As illustrated in FIGS. 3–5 the noise-maker or beeper 10 includes a hollow cylindrical member 11 of predetermined length and having an outer surface to snugly fit into passageway 8 and one end open to the atmosphere adjacent heel 5. A pair of ledges 12 are secured to an inner surface of hollow member 11 in a spaced, diametric relationship. A vibrating member 13 extending the full length of hollow member 11 rests on the ledges 12 to make a beeping sound when air passes thereby in one direction only, namely, only when the material 6 is deflated upon a step being made by a person wearing the footwear 1. A solid half cylindrical member 14 is disposed in hollow member 11 resting on vibrating member 13 adjacent the one end, occupying less than the predetermined length and snugly engaging the inner surface of hollow member 11. A tab 15 extending from the solid member 14 into the hollow member 11 rests on the vibrating member 13 to assist in making the beeping sound and a half enclosure member 16 is disposed at other end of the hollow member 11 below the vibrating member 13.

The vibrating member 13 may be made from a metal foil, a thin piece of plastic, a thin piece of wood or similar material that will vibrate. The hollow member 11, the pair of ledges 12, the solid member 14, the tab 15 and the enclosure member 16 can be made of plastic or other suitable materials that are easily manufactured and assembled.

The one-way air noise-maker or beeper 10 can be made of any size but preferably is approximately ½" in length and ¼" in diameter. The dimensions of noise-maker 10 will be dependent upon the type of sole 2 employed in footwear 1. In other words, the size of the beeper 10 must conform to the space provided in the sole 2.

In operation, when a step is taken the material 6 is deflated and the air is forced through passageway 8 and through the noise-maker 10 so that the air will cause the vibrating member 13 in conjunction with tab 15 and ledges 12 to vibrate and make the beeping sound. Vibrating member 13 will be caused to strike ledges 12 and tab 15. After the step is taken, the material 6 will suck air through the noise-maker 10 which air will pass between the ledges 12 and through the vibrating member 13 without making noise since it will not strike ledges 12. Therefore, the noise-maker 10 of the present invention will cause only one beep, or noise, for each step.

While I have described above the principles of my invention in connection with specific apparatus, it is to be clearly understood that this description is made only by way of example and not as a limitation to the scope of my invention as set forth in the objects thereof and in the accompanying claims.

I claim:

1. A noise-making sole for footwear comprising:

a sole for said footwear having an inner surface including a cavity and an outer surface including a heel;

a spongy material disposed within said cavity and adjacent said sole inner surface over a majority thereof in a location remote from said heel;

a sheet of material covering said inner surface and said spongy material;

a passageway disposed in said sole in communication with said spongy material in said cavity and an exterior of said heel at a back of said footwear; and a one-way air noise-maker disposed in said passageway adjacent said exterior of said heel, said noise-make enabling said spongy material to draw air therethrough after a step is taken and said spongy material is deflated to inflate said spongy material without emitting noise and to make noise by air passing therethrough when a step is taken and said spongy material is deflated thereby providing only a single noise per step of a person wearing said footwear.

2. A noise-making sole according to claim 1, wherein a spongy material includes a selected one of a sponge, spongy plastic, spongy cellulose and spongy rubber.

3. A noise-making sole according to claim 2, wherein said sheet of material includes a selected one of a plastic sheet, a fiber sheet and a cardboard sheet.

4. A noise-making sole according to claim 3, wherein said one-way air noise-maker includes a one-way air beeper giving off a single beep for each step of said person.

5. A noise-making sole according to claim 4, wherein said one-way air beeper includes a hollow cylindrical member of predetermined length having an outer surface to snugly fit said passageway and one end open to the atmosphere adjacent said heel;

a pair of ledges secured to an inner surface of said hollow member in a spaced, diametric relationship;

a vibrating member extending the length of said hollow member and resting on said pair of ledges to make a beeping sound;

a solid, half cylindrical-like member disposed in said hollow member resting on said vibrating member adjacent said one end, occupying less than said predetermined length and snugly engage said inner surface of said hollow member;

a tab extending from said solid member into said hollow member resting on said vibrating member to assist in making said beeping sound; and a half enclosure member disposed at the other end of said hollow member below said vibrating member.

6. A noise-making sole according to claim 5, wherein said vibrating member includes a selected one of a metal foil, a thin piece of plastic and a thin piece of wood.

7. A noise-making sole according to claim 6, wherein said hollow member, said pair of ledges, said solid member, said tab and said enclosure member are plastic.

8. A noise-making sole according to claim 5, wherein said hollow member, said pair of ledges, said solid member, said tab and said enclosure member are plastic.

9. A noise-making sole according to claim 1, wherein said sheet of material includes a selected one of a plastic sheet, a fiber sheet and a cardboard sheet.

10. A noise-making sole according to claim 9, wherein said one-way air noise-maker includes a one-way air beeper giving off a single beep for each step of said person.

11. A noise-making sole according to claim 10, wherein said one-way air beeper includes a hollow, cylindrical-like member of predetermined length having an outer surface to snugly fit said passageway and one end open to the atmosphere adjacent said heel;

a pair of ledges secured to an inner surface of said hollow member in a spaced, diametric relationship;

a vibrating member extending the length of said hollow member and resting on said pair of ledges to make a beeping sound;

a solid, half cylindrical-like member disposed in said hollow member resting on said vibrating member adjacent said one end, occupying less than said predetermined length and snugly engage said inner surface of said hollow member;

a tab extending from said solid member into said hollow member resting on said vibrating member to assist in making said beeping sound; and a half enclosure member disposed at the other end of said hollow member below said vibrating member.

12. A noise-making sole according to claim 11, wherein said vibrating member includes a selected one of a metal foil, a thin piece of plastic and a thin piece of wood.

13. A noise-making sole according to claim 10, wherein said hollow member, said pair of ledges, said solid member, said tab and said enclosure member are plastic.

14. A noise-making sole according to claim 1, wherein said one-way air noise-maker includes a one-way air beeper giving off a single beep for each step of said person.

15. A noise-making sole according to claim 14, wherein said one-way air beeper includes a hollow, cylindrical member of predetermined length having an outer surface to snugly fit said passageway and one end open to the atmosphere adjacent said heel;

a pair of ledges secured to an inner surface of said hollow member in a spaced, diametric relationship;

a vibrating member extending the length of said hollow member and resting on said pair of ledges to make a beeping sound;

a solid, half cylindrical member disposed in said hollow member resting on said vibrating member adjacent said one end, occupying less than said predetermined length and snugly engage said inner surface of said hollow member;

a tab extending from said solid member into said hollow member resting on said vibrating member to assist in making said beeping sound; and a half enclosure member disposed at the other end of said hollow member below said vibrating member.

16. A noise-making sole according to claim 15, wherein said vibrating member includes a selected one of a metal foil, a thin piece of plastic and a thin piece of wood.

17. A noise-making sole according to claim 15, wherein said hollow member, said pair of ledges, said solid member, said tab and said enclosure member are plastic.

18. A noise-making sole according to claim 1, wherein said one-way air noise-maker includes a hollow, cylindrical member of predetermined length having an outer surface to snugly fit said passageway and one end open to the atmosphere adjacent said heel;

a pair of ledges secured to an inner surface of said hollow member in a spaced, diametric relationship;

a vibrating member extending the length of said hollow member and resting on said pair of ledges to make a beeping sound;

a solid, half cylindrical member disposed in said hollow member resting on said vibrating member adjacent said one end, occupying less than said predetermined length and snugly engage said inner surface of said hollow member;

a tab extending from said solid member into said hollow member resting on said vibrating member to assist in making said beeping sound; and a half enclosure member disposed at the other end of said hollow member below said vibrating member.

19. A noise-making sole according to claim 18, wherein said vibrating member includes a selected one of a metal foil, a thin piece of plastic and a thin piece of wood.

20. A noise-making sole according to claim 18, wherein said hollow member, said pair of ledges, said solid member, said tab and said enclosure member are plastic.

* * * * *

US005640788C1

(12) EX PARTE REEXAMINATION CERTIFICATE (6637th)

United States Patent
Thange

(10) Number: US 5,640,788 C1
(45) Certificate Issued: Feb. 3, 2009

(54) NOISE-MAKING SOLE FOR FOOTWEAR

(75) Inventor: Maqsood Thange, Islin, NJ (US)

(73) Assignee: Softrend, Inc., Monmouth Junction, NJ (US)

Reexamination Request:
No. 90/009,146, May 12, 2008

Reexamination Certificate for:

| | |
|---|---|
| Patent No.: | **5,640,788** |
| Issued: | **Jun. 24, 1997** |
| Appl. No.: | **08/598,653** |
| Filed: | **Mar. 8, 1996** |

(51) Int. Cl.
*A43B 23/00* (2006.01)

(52) U.S. Cl. ..... 36/139; 36/112
(58) Field of Classification Search ..... None
See application file for complete search history.

(56) References Cited

U.S. PATENT DOCUMENTS

| | | | |
|---|---|---|---|
| 2,721,420 | A | 10/1955 | Chatten |
| 3,738,024 | A | 6/1973 | Matsuda |
| 4,253,254 | A | 3/1981 | Gill |
| 4,787,100 | A | 11/1988 | Jonat |
| 5,421,107 | A | 6/1995 | Bryan |

*Primary Examiner*—Beverly M. Flanagan

(57) ABSTRACT

A sole for the footwear has an inner surface and an outer surface including a heel. A spongy material is disposed adjacent the inner surface over a majority of the sole remote from the heel and a sheet of material covers the inner surface and the spongy material. A cylindrical passageway is disposed in the sole in communication with the spongy material and an exterior of the heel adjacent a back of the footwear. A one-way air noise-maker is disposed in the passageway adjacent the exterior of the heel, the noise-maker enabling the spongy material to draw air therethrough after a step is taken and the spongy material is deflated to inflate the spongy material without emitting noise and to make noise by air passing therethrough when a step is taken and the spongy material is deflated thereby providing only a single noise per step of a person wearing the footwear.

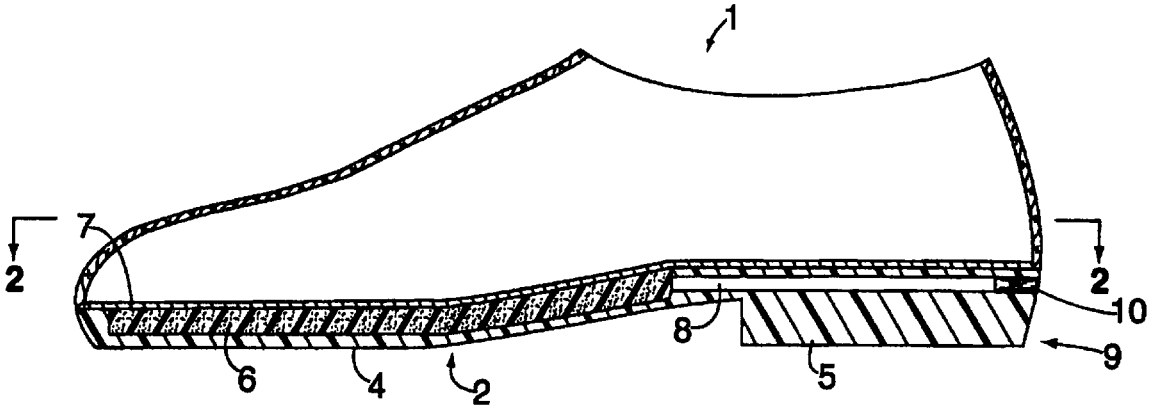

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1, 2, 3, 4, 9, 10 and 14 is confirmed.

Claims 5–8, 11–13 and 15–20 were not reexamined.

* * * * *